US005618029A

United States Patent [19]

Chung

[11] Patent Number: 5,618,029

[45] Date of Patent: Apr. 8, 1997

[54] JACK SAFETY DEVICE

[76] Inventor: Loan Chung, 4F, No. 6, Lane 48, Yen Chi Street, Taipei, Taiwan

[21] Appl. No.: 444,693

[22] Filed: May 19, 1995

[51] Int. Cl.[6] ..... B66F 5/04

[52] U.S. Cl. ..... 254/8 B

[58] Field of Search ..... 254/8 B, 2 B, 254/124

[56] References Cited

U.S. PATENT DOCUMENTS

| | | | |
|---|---|---|---|
| 1,738,622 | 12/1929 | Weaver et al. | 254/8 B |
| 2,624,543 | 1/1953 | Jackson | 254/8 B |
| 4,251,056 | 2/1981 | Maniglia | 254/8 B |
| 4,289,299 | 9/1981 | Kameda | 254/8 B |
| 5,221,073 | 6/1993 | Shockley | 254/8 B |

*Primary Examiner*—Robert C. Watson
*Attorney, Agent, or Firm*—Pro-Techtor International

[57] ABSTRACT

The present invention relates to a jack safety device which may prevent the accident of the object falling down due to the failure of lifting mechanism of the jack, comprising a safety hook, swingingly pivotted on the lifting arm or lever of said holding mechanism, when elevating and decending said holding mechanism may drive said safety hook reciprocally moving forward and backward; and a hook-up portion having tooth shape for said safety hook to hook up, when said safety hook moves forward it may hook up with said tooth shape to limit it from moving backward so that said holding mechanism can not decend to attain the purpose of safety and protection; and a lever for pushing said safety hook to disengage with said hook-up portion in order to let said holding mechanism decending.

2 Claims, 7 Drawing Sheets

JACK SAFETY DEVICE

BACKGROUND OF THE INVENTION

The present invention relates to a jack safety device, and particularly to a jack safety device which may prevent the accident of the object falling down due to the failure of lifting mechanism of the jack.

A hydraulic jack in general has used a hydraulic cylinder as lifting mechanism. If because of breakage or oil leakage on the hydraulic cylinder, the object under holding will fall down swiftly owing to sudden missing of lifting force from the jack and therefore to cause accidental injury.

Further because of space and mechnism limit to a small hydraulic cylinder in general, it has not found a practical safety device so that it gives no protection for use.

SUMMARY OF THE INVENTION

One object of the present invention is to provide a jack safety device which may prevent the risk of the object falling down due to sudden drop of lifting mechanism of the jack.

Another object of the present invention is to provide a jack safety device of simple structure and cheap cost.

Still another object of the present invention is to provide a jack safety device which is highly safe and convenient for use.

DETAILED DESCRIPTION OF THE PREFERRED EMBODIMENTS

The present jack safety device relates to a safety protection device to prevent the lifting mechanism of jack from going down after elevation so as to maintain lifting state to avoid accident of the object under holding falling down.

Take a carriage jack as an example, however, the present device is not limited to the following purposes. The present safety device may apply to other types of jack if with swing lifting arm or lever.

Figure 1:
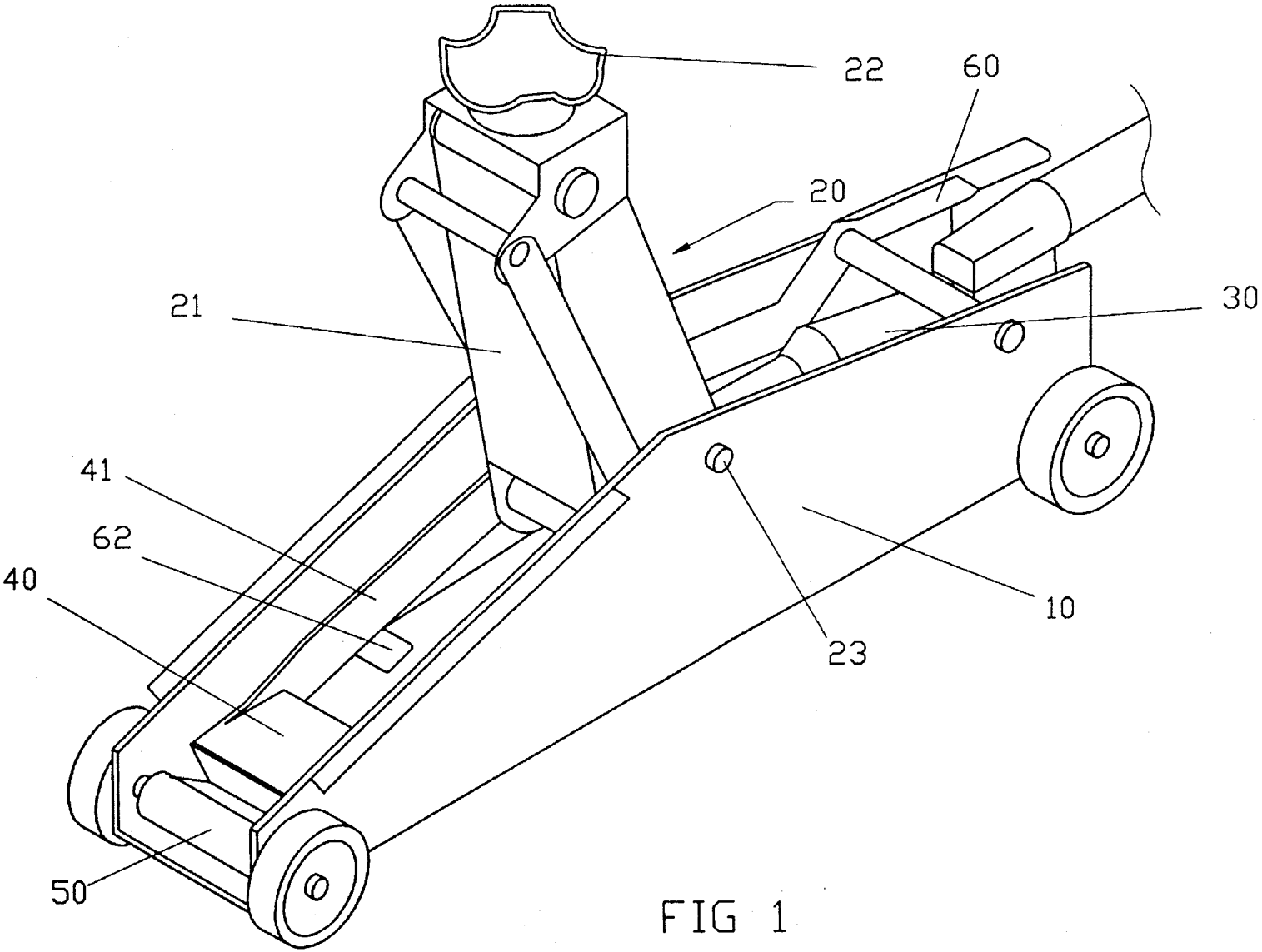
FIG. 1 is an elevational view of the present jack.
Figure 2:
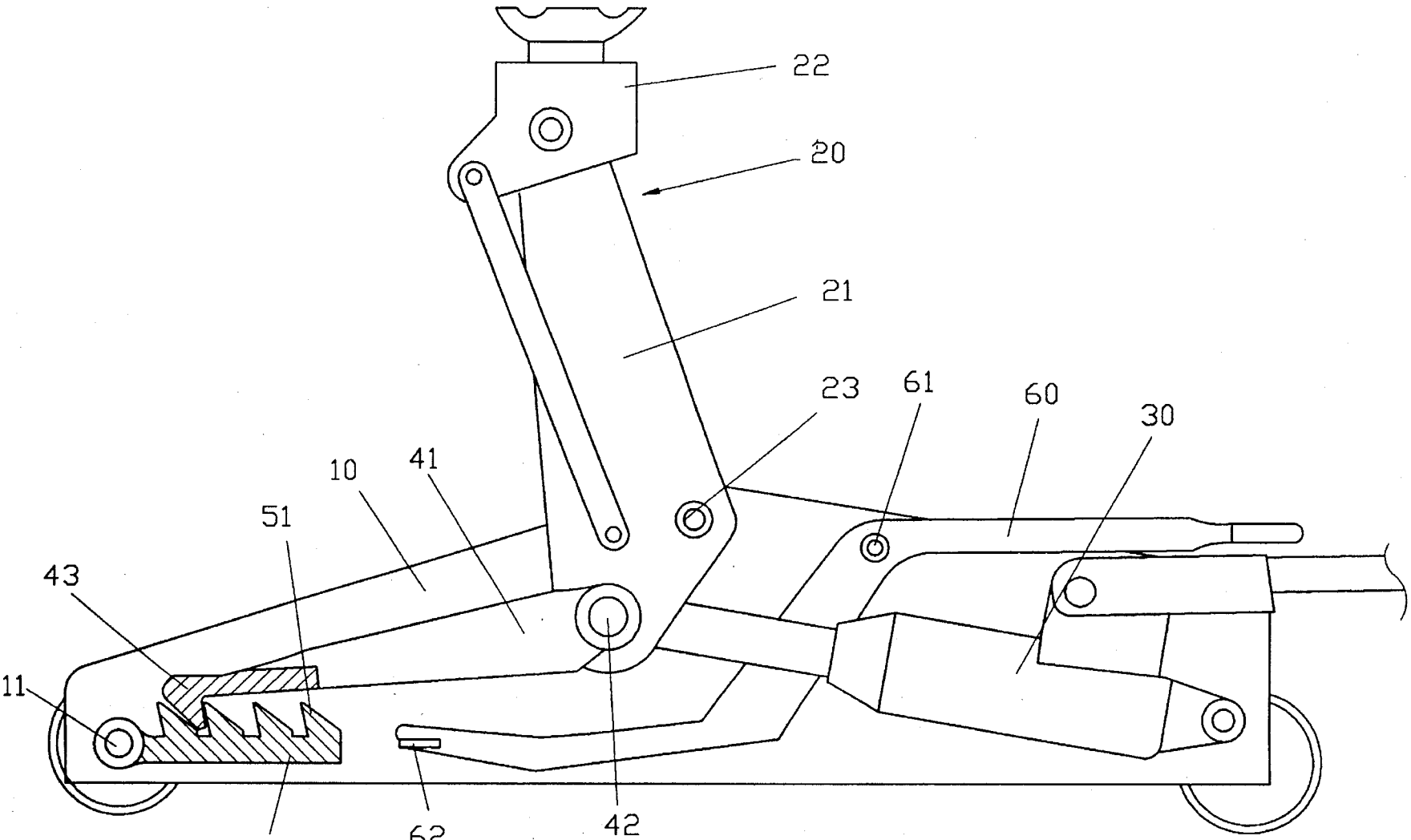
FIG. 2 is a side-exploded view showing the structure and allocation of the present invention.

Referring to FIGS. 1 and 2, the present jack comprises a main body 10, a holding mechanism 20 having a lifting arm 21 swinging up-and-down and pivotted to said main body, on the top end of said lifting arm 21 having a holding portion 22 for holding the object, and a lifting mechanism mechanism 30 for driving said lifting arm 21 swinging upwardly while enabling the holding portion 22 to lift up the object.

The present safety device comprises a safety hook 40 pivotally attached to said lifting arm 21, and a hook-up portion 50 for said safety hook 40 to hook up. When lifting up said lifting arm 21 may lead said safety hook 40 to hook said hook-up portion 50 and upon said safety hook 40 hooking said hook-up portion 50, said safety hook 40 will be limited not to retreat, except as the operator has pushed up said safety hook 40 otherwise said safety hook 40 will not separate with hook-up portion 50 so that it may limit said lifting arm 21 to maintain lifting state without sudden descending due to failure of said lifting mechanism 30 to accomplish the purpose of safety protection.

Figure 3:
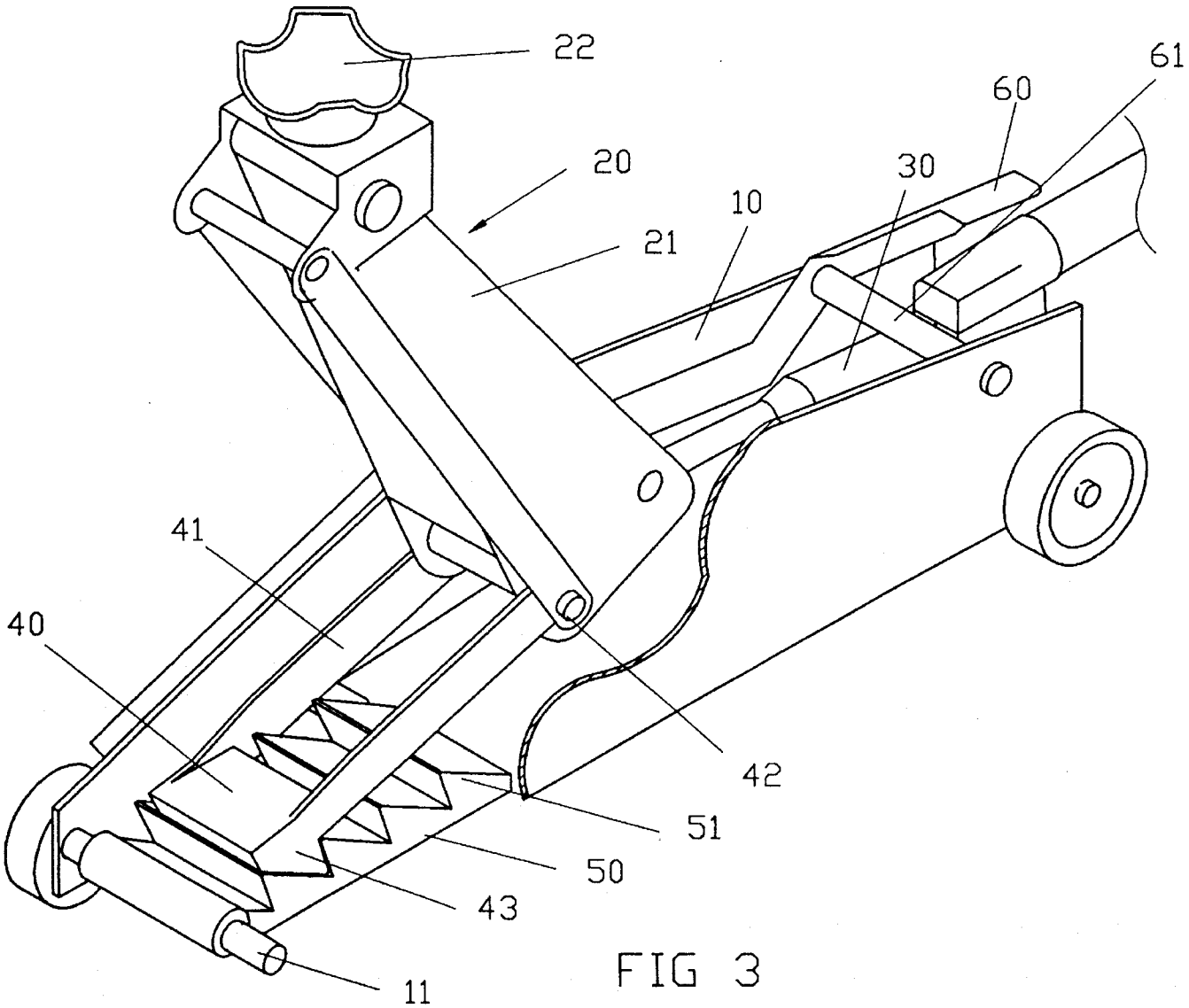
FIG. 3 is a partially-enlarged and elevational view of the safety device of the present jack.
Figure 4:
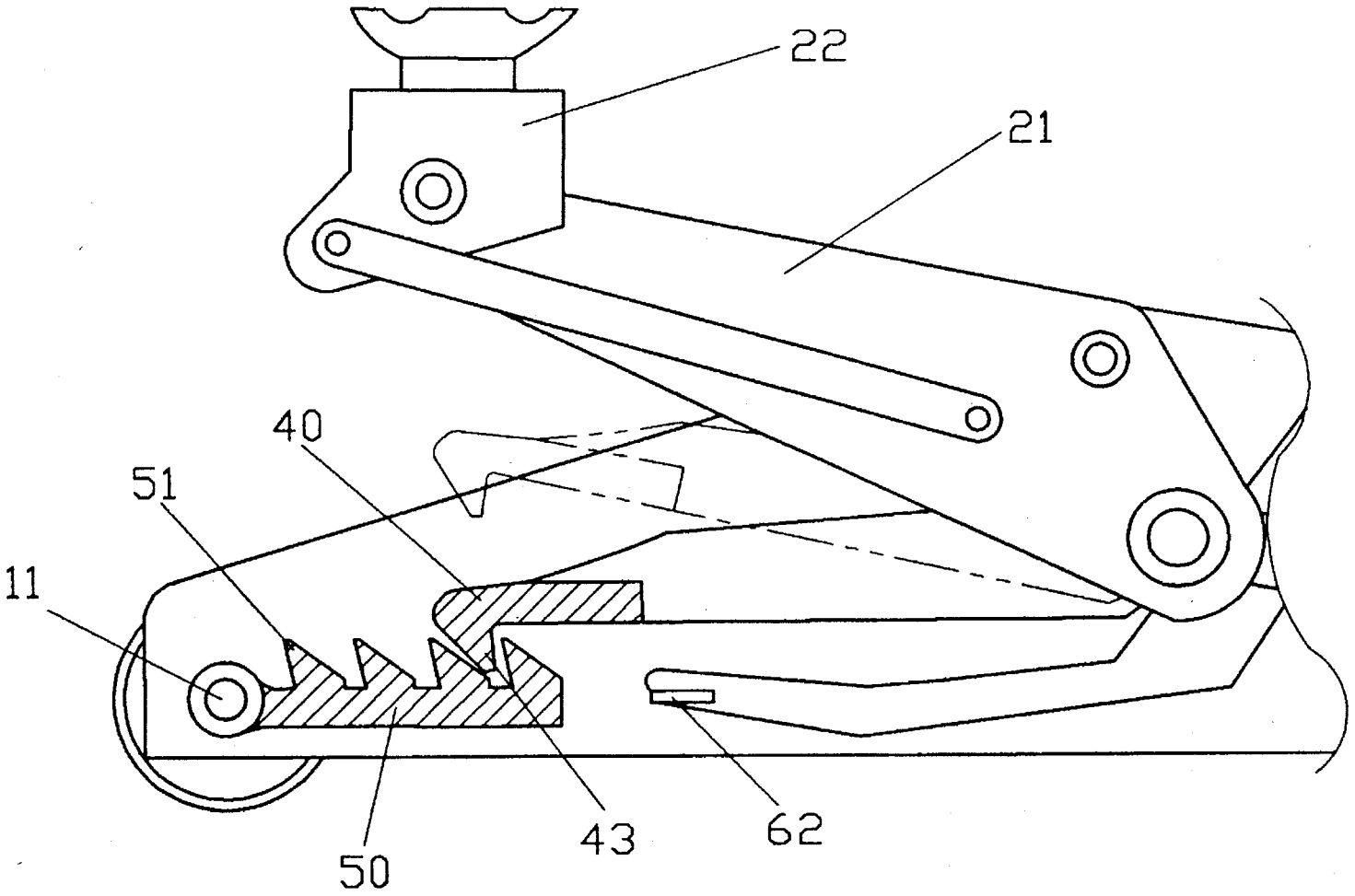
FIG. 4 thru FIG. 6 are the diagram of continuous action of the safety device of the present invention.
Figure 5:
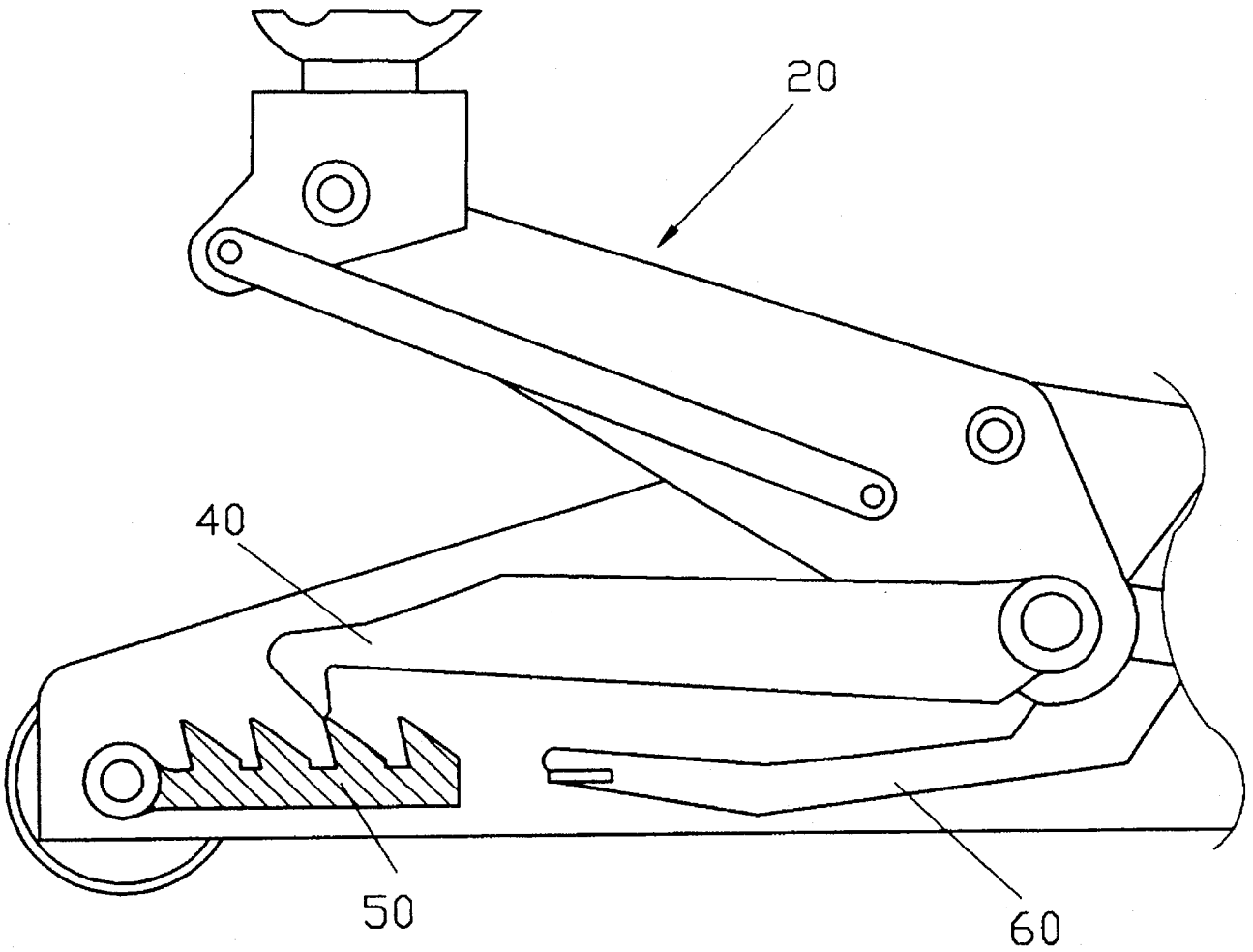
Figure 6:
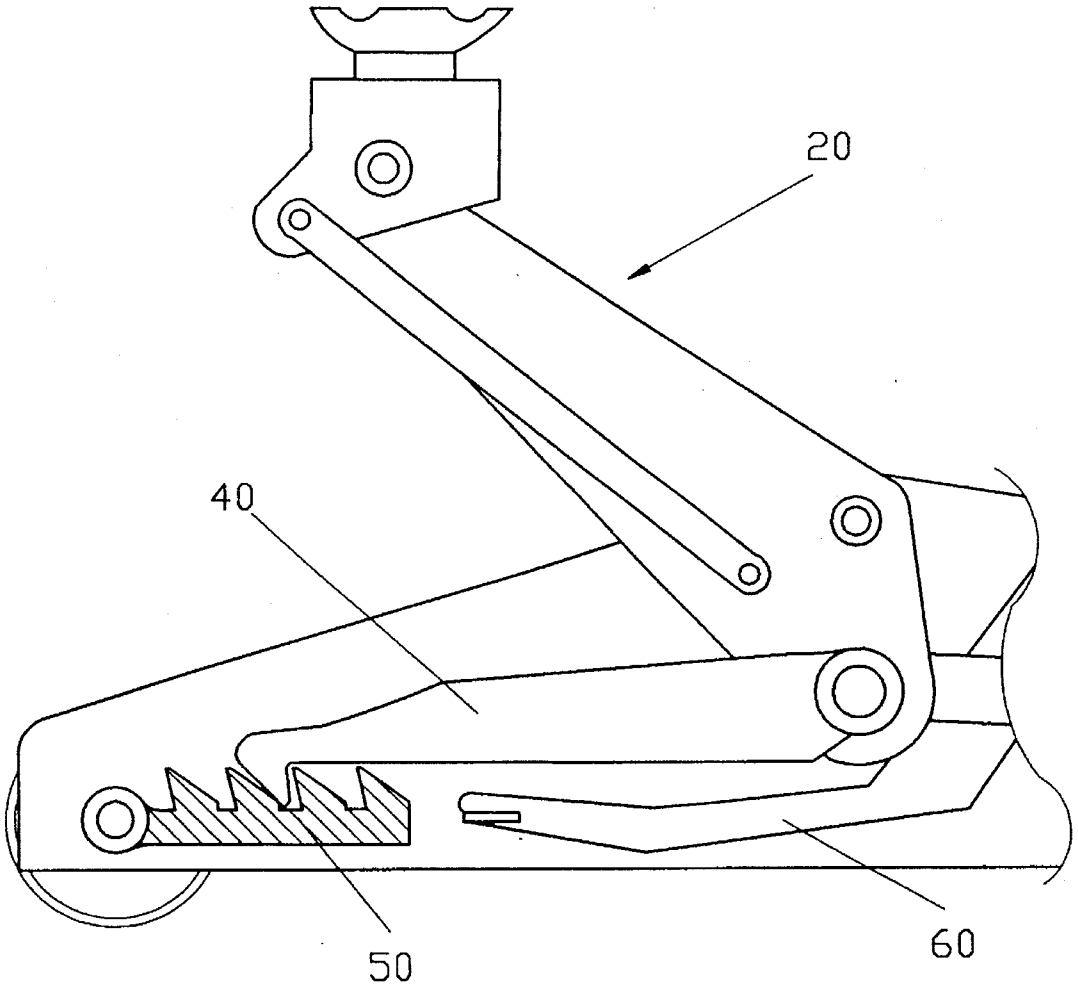

Referring to FIG. 3, said safety hook 40 includes two parallel lever arms 41, with one end pivotted to said lifting arm 21 by means of pin 42, and the other end having a hook tooth 43. Referring to FIGS. 4 thru 6, said pin 42 is provided for fixing the fixing shaft 23 of said lifting arm 21, when said lifting arm 21 is swinging up around said fixing shaft 23, said safety hook 40 will be pushed forward. In the said embodiment, the pin 42 is provided for said lifting mechanism 30 in connection with the pin of lifting arm 21 so that no modification for said lifting arm 21 will be needed in order to mount said safety hook 40 on said lifting arm 21.

The hook tooth 43 on the front end of said safety hook 40 resembles reversed hook tooth while said hook-up portion 50 has a row of tooth 51 for hooking up said hook tooth 43. Because of hook tooth 43 of said safety hook 40 appearing back bevel and said lever arm 41 swinging, when said safety hook 40 is pushed forward by said lifting arm 21, said hook tooth 43 can be pushed up by the tooth row 51 of said hook-up portion while sliding by virtue of the top end of said tooth row 51, when said safety hook 40 moves backward, said safety hook 40 may fall down owing to the function of gravity so that said hook tooth 43 may gear up with said tooth row 51 to cause said safety hook 40 not to move backward so as to prevent said lifting arm 21 from decending.

The tooth row 51 on said hook-up portion 50 is reciprocally arranged within the moving range of said hook tooth 43 along said safety hook 40 so that within lifting angle range of said lifting arm 21 said hook tooth 43 may gear up with said tooth row 51 to enable safety device to give protection for the object at which height it is lifted by the jack.

To ensure that said safety hook 40 may actually hook up with hook-up portion, said safety hook 40 had better mount on the position higher than said hook-up portion 50 to enable safety hook 40 for hooking on said hook-up portion 50 by means of gravity.

Figure 7:
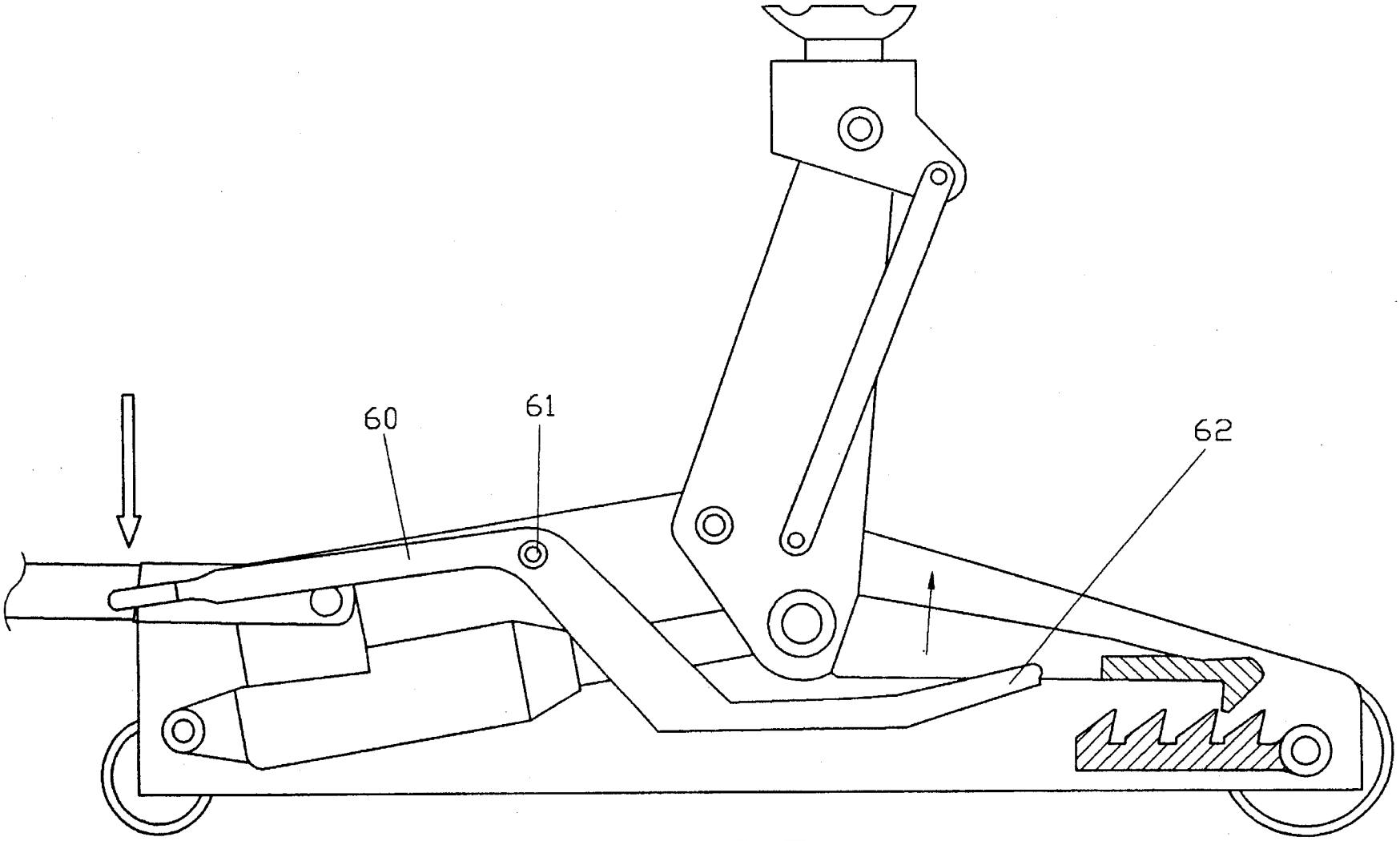
FIG. 7 is the diagram showing the action of the lever of the present invention.

The operation of said jack has not much difference with the conventional jack, and the only difference lies in if the jack is to release lifting arm for lowering the object under holding it has to cause said safety hook 40 disengaging with said hook-up portion 50. The present invention increases the operator with safety and convenience for the aforesaid procedure, on said jack has a lever 60 for causing said safety hook 40 to disengage with said hook-up portion 50. Referring to FIG. 7, said lever 60 uses a pin 61 inserting through the intermediate portion while pivotted on said main body 10. On the front end of said lever 60 has push plate 62 to contact said lever arm 41 and distal end is extending to the distal end of said main body 10 so that the operator can easily touch the position. The operator may push down the end of said lever 60 enabling the front end of said lever to rise while enabling push plate 62 to lift up said safety hook 40 to disengage with said hook-up portion 50.

In addition, to ensure that said safety hook 40 can disengage with hook-up portion 50, said hook-up portion 50 is pivotally mounted on the front wheel shaft 11 of said main body 10. When said safety hook 40 disengages with said hook-up portion 50, said hook-up portion 50 pivots about said front wheel shaft 11 away from said safety hook 40 to ensure that said hook-up portion 50 does not become entangled with said hook tooth 43.

With the safety device of the present invention, it may use said safety hook 40 to match hook-up portion 50 for stopping said lifting arm 21 from decending when said jack is in use therefore it gives excellent safety protection without need of any other auxiliary support to hold the object so that is increases the facility of use. And with such installation may enable said safety hook 40 and hook-up portion 50 to sustain pressure after engagement to become a straight line so as to ensure that the both can hook up stably.

Another advantage of the present invention lies in the aforesaid safety hook 40 and hook-up portion 50 that may be mounted in the main body of the present structure of the jack without any modification of the structure of the jack so that it is very convenient and cheap for mounting.

I claim:

1. A jack safety device comprising:

a safety hook pivotally attached to a lifting arm affixed to a main body of said jack, an axis of rotation of said safety hook is removed from an axis of rotation of said lifting arm, said safety hook having at least one reverse-bevelled hook tooth, a hook-up portion pivotally mounted on said main body so as to contact said safety hook, said hook-up portion including a plurality of teeth that engage said hook tooth; wherein raising a lifting arm of said jack causes said tooth hook to engage one of said teeth of said hook-up portion, said hook tooth advancing along said hook-up portion as said lifting arm is raised further, a meshing of said hook tooth with said teeth of said hook-up portion positively restricting downward movement of said lifting arm when a lifting force is removed from said lifting arm.

2. The jack safety device of claim 1 wherein:

said safety device includes a lever member pivotally attached to said main body, said lever member disengaging said hook tooth from said hook-up portion when pressure is applied to said lever member by a user of said safety device.

* * * * *